United States Patent [19]

Hata

[11] Patent Number: 4,831,371

[45] Date of Patent: May 16, 1989

[54] ELECTROSTATIC PIXEL MODULE CAPABLE OF PROVIDING SIZE VARIABLE PIXELS

[75] Inventor: Kazuo Hata, Kakogawa, Japan

[73] Assignee: Daiwa Shinku Corporation, Hyogo, Japan

[21] Appl. No.: 95,756

[22] Filed: Sep. 11, 1987

[30] Foreign Application Priority Data

Sep. 13, 1986 [JP] Japan ..... 61-141232[U]

[51] Int. Cl.[4] ..... G09G 3/34

[52] U.S. Cl. ..... 340/783; 340/815.04; 340/805

[58] Field of Search ..... 340/783, 815.04, 815.27, 340/805, 752, 763, 764, 788; 40/427; 350/269, 486

[56] References Cited

U.S. PATENT DOCUMENTS 4,229,732 10/1980 Hartstein et al. ..... 340/783
4,468,663 8/1984 Kalt ..... 340/783
4,741,599 5/1988 Togo et al. ..... 340/783

*Primary Examiner*—Donald J. Yusko
*Assistant Examiner*—M. Fatahiyar
*Attorney, Agent, or Firm*—Koda and Androlia

[57] ABSTRACT

An electrostatic pixel module capable of providing size-variable pixels for use in an electrostatic display board. The module is made up of a known electrostatic display elements arranged so as to form a substantially square-faced pixel unit consisting of four substantially square-faced sub-pixel units. The four sub-pixel units, when operated collectively, provide a larger pixel; and when operated independently, provide four smaller pixels.

4 Claims, 5 Drawing Sheets

ELECTROSTATIC PIXEL MODULE CAPABLE OF PROVIDING SIZE VARIABLE PIXELS

BACKGROUND OF THE INVENTION

The present invntion relates to an electrostatic display module made capable of providing variable-sized pixels.

An electrostatic display element as shown perspectively in FIG. 6(*a*) and cross-sectionally (along line A—A of FIG. 6(*a*)) in FIG. 6(*b*) can be used as a pixel element in a pattern display board by constituting the board with many such electrostatic display elements arranged, for example, in the form of a matrix. In principle, the electrostatic display element consists of an assembly of a pair of fixed electrodes 1 and 2 kept oppositely to each other and a movable electrode 3 positioned therebetween. The fixed electrodes 1 and 2 are coated on their confronting surfaces with differently colored elecrically insulating layers 11 and 21 and have their respective middle frank portions made curved inwardly to form hemi-cylindrical inward prostrusions 12 and 22. The movable electrode 3, which is usually made of a metal-plated mirror-faced flexible thin film, is hold by a film holder 4 and then, together with a terminal plate 5, secured between the fixed electrodes 1 and 2 at their flat portions under the hemi-cylindrical inward protrusions 12 and 22 with electrically insulating spacers 6 and 7 interposed. In such a mechanical constitution of the element, the fixed electrodes 1 and 2 are kept voltage-supplied, while the movable electrode 3 is electrically switched selectively to either of the fixed electrtodes 1 and 2. If the movable electrode 3 is switched to the fixed electrode 2, the movable electrode 3, whose potential is made equal to that of the fixed electrode 2, is attracted by and to the fixed electrode 1 (and repelled by and from the fixed electrode 2) to bend toward the fixed electrode 1, masking the insulating layer 11 on the fixed electrode 1 and exposing the layer 21 on the fixed electrode 2. At such a posture of the movable electrode 3, the layer 21 is not only exposed but also reflected by the mirrored surface of the movable electrode 3. Thus, the electrostatic display element, seen from above, appears to have the color of the insulating layer 21. Needless to repeat a similar description, if the movable electrode 3 is switched to the fixed electrode 1, the electrostatic display element comes to be represented by the color of the insulating layer 11. Since the appearance of the electrostatic display element is thus changed according to the potential selection of the movable electrode 3, the element can be used as a pixel of a pattern display board.

Further, though the pixel made of such an element as shown in FIGS. 6(*a*) and 6(*b*) is rectangular because of the rectangular-shaped opening on top of the pair of fixed electrodes, a square pixel, if desired, can be constituted by combining two such electrostatic display elements into one unit with the individual fixed electrode pairs arranged in parallel to each other. Examples of such are seen in some embodiments of the present invention.

Whether the pixel is square or not, its size is determined by the size of the electrostatic display elements used. On the other hand, a larger display pattern to be seen more remotely can generally be constituted of relatively large-sized pixels, and a smaller display pattern be seen less remotely is necessarily constituted of small-sized pixels in general. In other words, the size of pixels depends on an apparent resolving power required of a display board. This means that the pixels, that is, the electrostatic display elements must be designed inconveniently in accordance with the size or the resolving power of an objective display board to be constituted.

OBJECTS AND SUMMARY OF THE INVENTION

The present invention aims at eliminating such incovenience accompanying the design of a display board consisting of electrostatic display elements, and makes it an object to provide an electrostatic display module made capable of varying the size of pixels of a pattern to be displayed.

Another object of the present invention is to constitute such an electrostatic display module so as to function purposefully only by changing the combination of electric wiring to the module. To achieve the above objects, the electrostatic display module according to the present invention consists of four squarely arranged subunits, and each of the subunits is made of a square-faced single electrostatic element (refer to FIG. 5) or of two rectangular-faced elements combined so as to form a square face. The thus constituted electrostatic display module can selectively provides two kinds of different-sized pixel or pixels: the display module serves as one large-sized pixel with the four constituent subunits operated so as to show the same appearance at the same time, while the display module, with the four subunits operated independently, provides four independent pixels having a size one-fourth times as small as that of the above one large pixel.

BRIEF DESCRIPTION OF THE DRAWINGS

The present invention is further described in detail in the following on reference to the accompanying drawings, in which.

DETAILED DESCRIPTION OF THE INVENTION

Figure 1A:
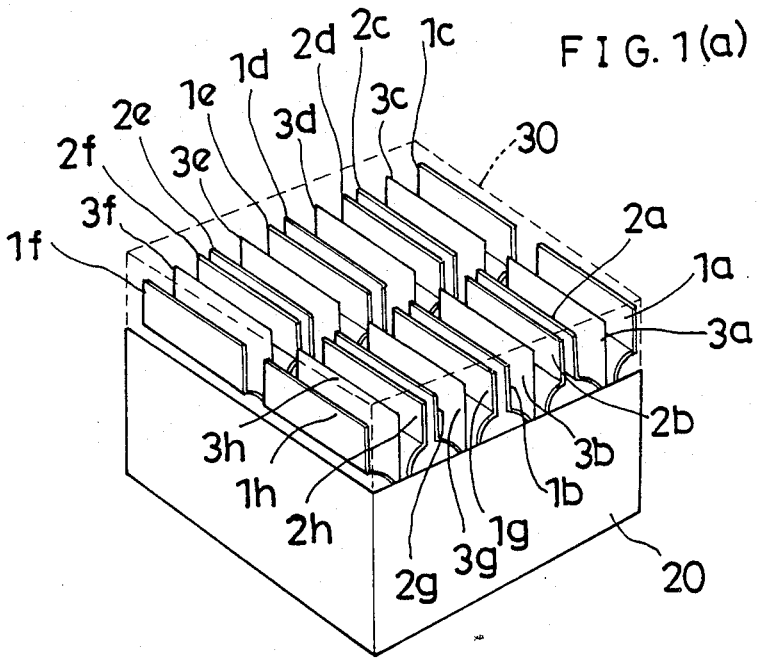
FIGS. 1(*a*), 1(*b*) and 1(*c*) respectively show the constitution of an embodiment of the present invention perspectively, plane-delineatively and cross-sectionally.
Figure 1B:
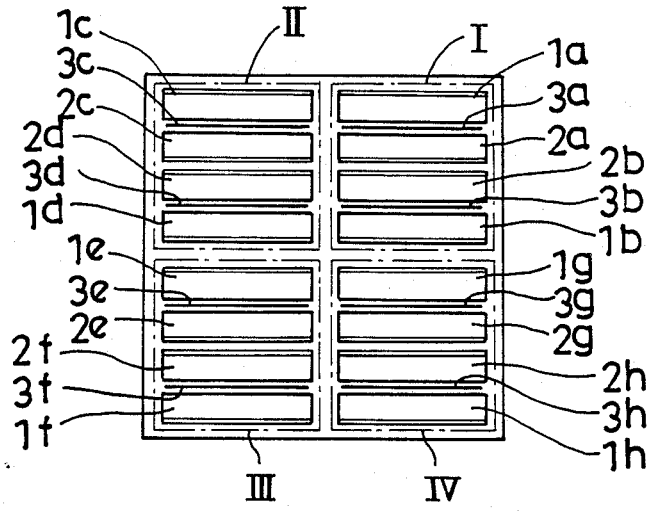
Figure 1C:
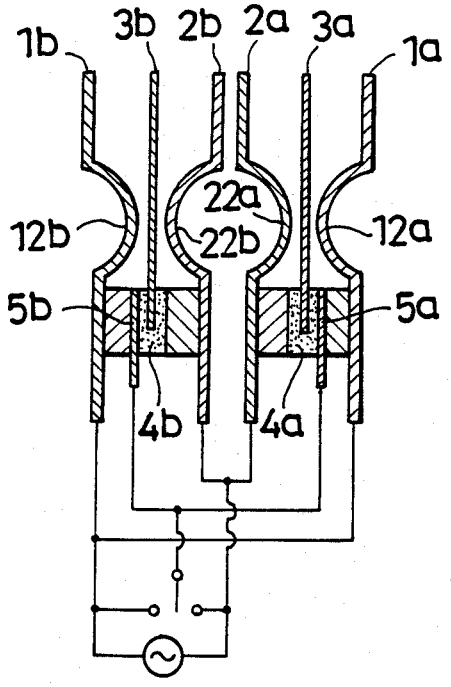
Figure 4:
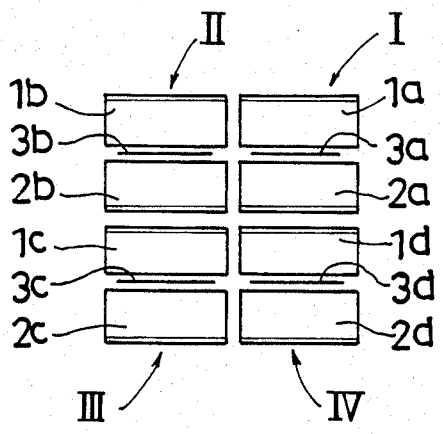
FIG. 4 shows a plane view of a still further embodiment of the present invention, in which embodiment square-faced electrostatic desplay elements are used.
Figure 5A:
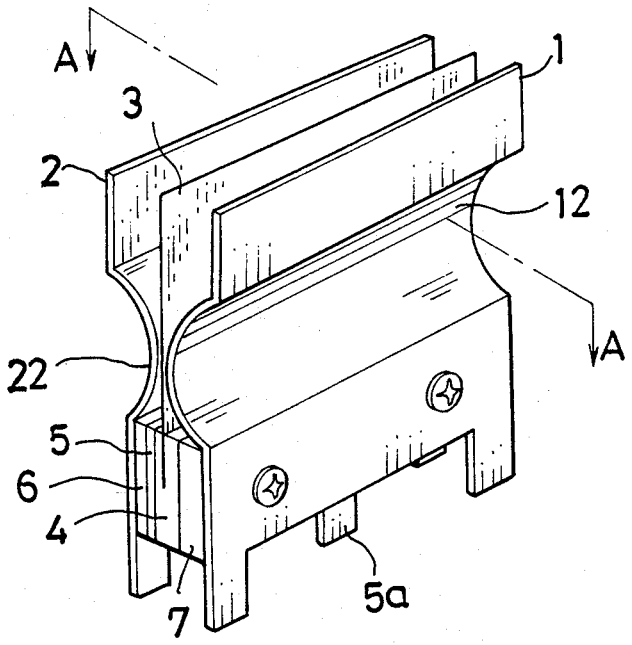
FIGS. 5(*a*) and 5(*b*) respectively show the perspective and cross-sectional details of a conventional electrostatic display element used in present invention.
Figure 5B:
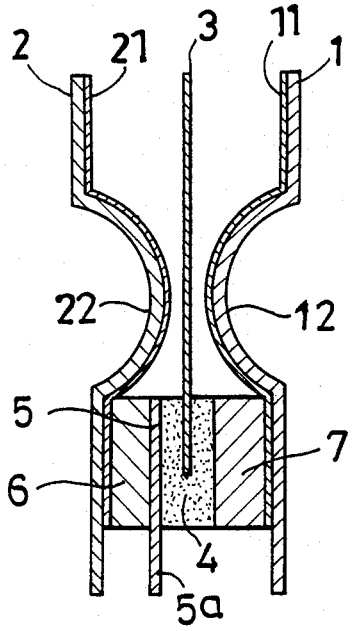

Referring to FIGS. 1(*a*) and 1(*b*), which respectively show a perspective and a plane view of an embodiment of the present invention, eight electrostatic display elements as shown in FIGS. 5(*a*) and 5(*b*) are grouped to form a display module. The module is confined in a case 20 protected on top with a transparent cover 30 from dust and moisture. Reference signs (consisting of arabic numerals accompanied by alphabetical suffixes) have their numeral parts made to represent the constituent members of individual display elements in the same manner as in FIGS. 5(*a*) and 5(*b*), and their suffix parts allotted for specifying particular display elements. In FIGS. 1(*a*) and 1(*b*), however, the colored insulating layers (corresponding to 11 and 12 in FIGS. 5(*a*) and 5(*b*)) coated on the (inner) surfaces of the fixed electrodes 1 and 2 are not pictured for avoiding the complexty of drawing. The omission of drawing the insulating layers and the above principle of reference signs application are applied also to all of the following drawings from FIG. 1(*c*) to FIG. 4.

With the description returned to the present embodiment, the eight electrostatic display module confined in the case 20 can be further subgrouped into four subunits I to IV (FIG. 1(*b*)). Each subunit consists of two electrostatic display elements arranged symmetrically with their fixed electrode pairs kept parallel to each other. Such constitution of the subunits is to make each subunit seemingly square. The arrangement of the two electrostatic display elements is, together with the wiring to them, illustrated in FIG. 1(*c*) with the subunit I examplified. Referring to FIG. 1(*c*), two equal electrostatic display elements are symmetrically arranged with the corresponding electrodes (both fixed and movable) connected electrically in common. In addition, one common connection group consisting of the fixed electrodes 1*a* and 1*b* and the other consisting of the fixed electrodes 2*a* and 2*b* are kept voltage-supplied therebetween, while a common connection of movable electrodes 3*a* and 3*b* is made capable of being selectively switched to either of the two common connection of fixed electrodes. As is easily understood analogically from the previously described function of the conventional (single) electrostatic display element shown in FIGS. 5(*a*) and 5(*b*), each of the thus constituted subunits I to IV functions as a square pixel because the two electrostatic display elements constituting the subunit have their appearances (colors) changed equally in two ways by the selected switching of the commonly connected movable electrodes 3*a* and 3*b*. Accordingly, if the four subunits I to IV are made operative independently from one another, the display module embodied as shown in FIGS. 1(*a*), 1(*b*) and 1(*c*) can provides four relatively small square pixels (each of which is one of the subunits). Further, this display module can be made to function as one large-sized pixel with the four subunits I to IV operated coincidentally. One easy method for this purpose is to make a common connection with respect to all of the corresponding equivalent electrodes belonging to the eight separate electrostatic display elements. The present embodiment thus provides an electrostatic display module capable of giving size-varying pixel. A display board having a variable resolution can be constituted with many such electrostatic display module arranged, for instance, in the form of a matarix.

Figure 2A:
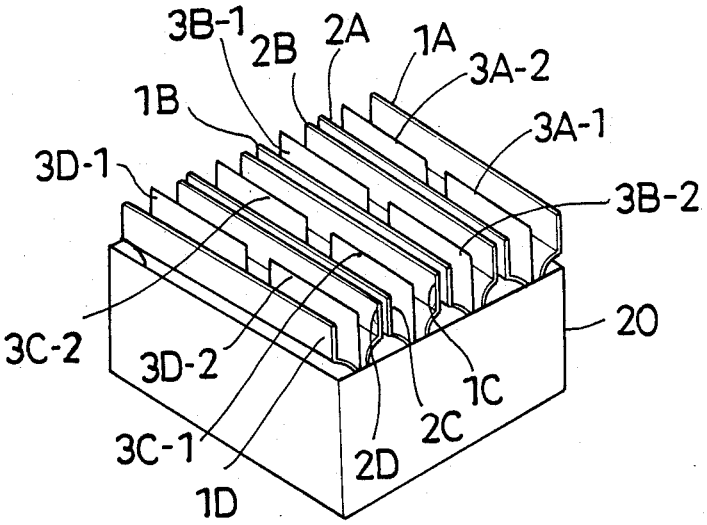
FIGS. 2(*a*) and 2(*b*) respectively show the constitution of a further embodiment of the present invention perspectively and plane-delineativity.
Figure 2B:
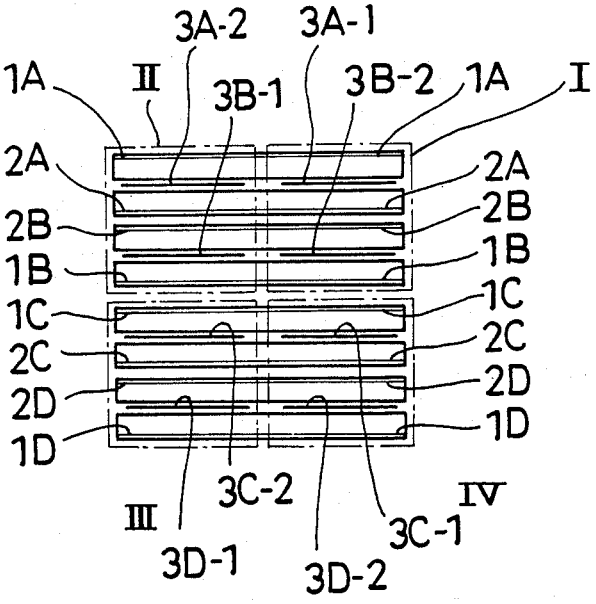

In a further embodiment of the present invention, the electrostatic display elements corresponding to those in the embodiment shown in FIGS. 1(*a*), 1(*b*) and 1(*c*) are mechanically unified, as is shown perspectively in FIG. 2(*a*) and plane delineatively in FIG. 2(*b*), in every two elements in their length direction. In this embodiment, each of subunits I to IV (FIG. 2(*b*)) corresponding to those in the embodiment shown in FIGS. 1(*a*), 1(*b*) and 1(*c*) is constituted of two halves of two electrostatic display elements adjacent to each other in the direction orthogonal to their length direction. To be concrete, a subunit I, for example, consists of the left halves of fixed electrodes 1A, 2A, 2B, 1B and two movable electrodes 3A-1 and 3B-2.

Figure 3A:
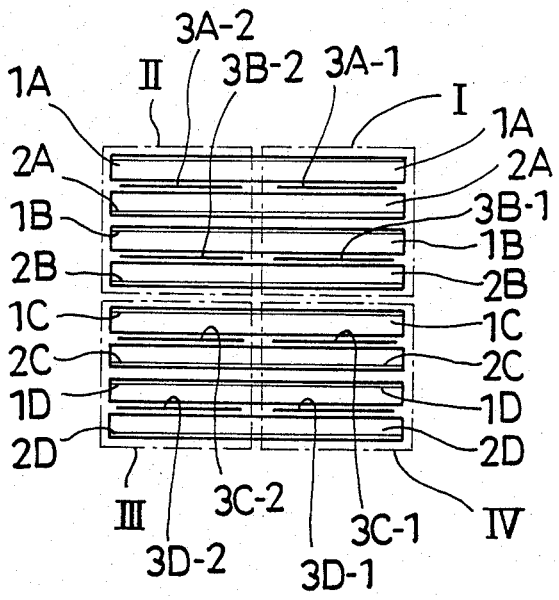
FIGS. 3(*a*) and 3(*b*) respectively show a plane view and a cross-sectional view of a modification of the embodiment illustrated in FIGS. 3(*a*) and 3(*b*)
Figure 3B:
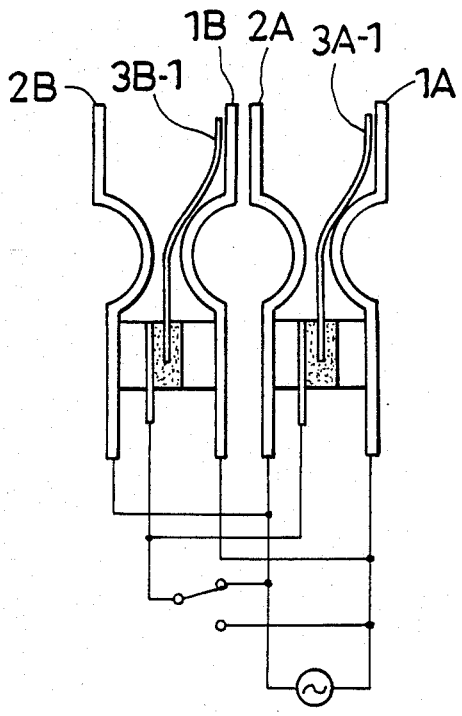

The above embodiments shown in FIGS. 2(*a*) and 2(*b*) is further modified as shown in FIGS. 3(*a*) and 3(*b*). FIG. 3(*a*), which shows a plane view of this modification, seems to be the same as FIG. 3(*b*), but different in their arrangement directions. In the preceding embodiment two adjacent electrostatic display elements are symetrically arranged as in the event of the embodiment shown in FIGS. 1(*a*), 1(*b*) and 1(*c*), while in the present modification they are arranged not symmetrically, but "in series" with respect to the direction orthogonal to their length direction. Accordingly, in the preceding embodiment the fixed electrode 2A of a forward electrostatic display element is followed by the fixed electrode 2B of the following element, while in the present modified embodiment the fixed electrode 2A of the forward element is following by the fixed electrode 1B of the following element. Such arrangement of electrostatic display elements in this case is cross-sectionally illustrated, together with the wiring among the electrodes, in FIG. 3(*b*) with the subunit I (see FIG. 3(*a*)) examplified. FIG. 3(*b*) shows a state that both two movable electrodes 3A-1 and 3B-1 are attracted to the right exposing the fixed electrodes 2A and 2B showing the same color. Because the the "series" (not symmetrical) arrangement of the two display elements, both the two movable electrodes 3A-1 and 3B-1 are attracted always in a common direction, whichever color of the fiexd electrodes is to be exposed. They are never bent so as to form a ridgeline as in the case where the previous embodiments expose the same colored electrodes 1*a* and 1*b* (FIG. 1(*a*), 1(*b*), 1(*c*)) or 1A and 1B (FIGS. 2(*a*), 2(*b*)). According to this modification, therefore, a glittering line is prevented from appearing along the above ridgeline.

The present invention is further embodied as shown in FIG. 4 plane-delineatively. In this embodiment, each of the four subunits I to IV consists of one electrostatic display element having the opening at its fixed electrode-pair made square.

As is understood from the above descriptions, the present invention provides an electrostatic display module made capable of selectively offering an large-sized pixel by operating the constituent electrostatic display elements coincidently and four small-sized pixels by operating the display elements independently from one another.

I claim:

1. A pixel module capable of providing size-variable pixels adoptable in an electrostatic display board consisting of two-dimensionally arrayed electrostatic display elements, each of which is made up of two differently colored fixed electrodes confronting each other and a film-like mirror-faced flexible electrode positioned between said two fixed electrodes, and is devised so as to make said flexible electrode be electrostatically attracted selectively to either of said two fixed electrodes, whereby each of said electrostatic display elements is viewed selectively in the color of either of said two fixed electrodes, said pixel module comprising:

a plurality of said electrostatic display elements arranged so as to form a substantially square-faced pixel unit consisting of four substantially square-faced sub-pixel units; and a switching network for selectively operating said four sub-pixel units either independently or coincidently whereby size-variable pixels are provided.

2. A pixel module defined in claim 1, wherein each of said sub-pixel units consists of a plurality of rectangular-faced electrostatic display elements.

3. A pixel module defined in claim 2, wherein each of said rectangular-faced electrostatic display units has its fixed electrodes prolonged over two adjacent sub-pixel units and has its flexible electrode divided into two so as to make each of the two belong to each of said two adjacent sub-pixel units.

4. A pixel module defined in claim 1, wherein each of said four substantially square-faced sub-pixels is constituted of one substantially square-faced electrostatic display element.

* * * * *